US010427851B2

(12) United States Patent
Steele et al.

(10) Patent No.: US 10,427,851 B2
(45) Date of Patent: Oct. 1, 2019

(54) PACKAGE WITH HEAT SCORE

(75) Inventors: Mark Steele, New Prague, MN (US); Greg Melchoir, Green Bay, WI (US)

(73) Assignee: Mark Steele, New Prague, MN (US)

( * ) Notice: Subject to any disclaimer, the term of this patent is extended or adjusted under 35 U.S.C. 154(b) by 524 days.

(21) Appl. No.: 13/340,608

(22) Filed: Dec. 29, 2011

(65) Prior Publication Data

US 2012/0196730 A1 Aug. 2, 2012

Related U.S. Application Data

(60) Provisional application No. 61/428,658, filed on Dec. 30, 2010, provisional application No. 61/432,183, filed on Jan. 12, 2011.

(51) Int. Cl.

| | |
|---|---|
| ***B26D 3/08*** | (2006.01) |
| ***B65D 75/58*** | (2006.01) |
| *B31B 160/10* | (2017.01) |
| *B31B 155/00* | (2017.01) |
| *B31B 70/00* | (2017.01) |
| *B31B 70/855* | (2017.01) |

(52) U.S. Cl.

CPC ..... *B65D 75/5827* (2013.01); *B65D 75/5816* (2013.01); *B31B 70/252* (2017.08); *B31B 70/855* (2017.08); *B31B 2155/00* (2017.08); *B31B 2155/001* (2017.08); *B31B 2160/10* (2017.08); *B65D 2575/586* (2013.01)

(58) Field of Classification Search

CPC ..... B65B 61/188; B31B 19/90; B31B 21/00; B31B 2219/252; B31B 2219/9058; B31B 2237/40; B31B 2237/10; B65D 2575/586; B65D 75/5816; B65D 75/5827

USPC ..... 493/224, 213, 214, 228, 229, 231, 240, 493/267

See application file for complete search history.

(56) References Cited

U.S. PATENT DOCUMENTS

| | | | | |
|---|---|---|---|---|
| 3,379,814 | A * | 4/1968 | Bracey, Jr. | B29C 65/18 264/293 |
| 3,942,640 | A | 3/1976 | Hellstrom | |
| 4,217,327 | A * | 8/1980 | Cancio et al. | 264/293 |
| 4,519,499 | A | 5/1985 | Stone et al. | |
| 4,993,844 | A | 2/1991 | Robinson et al. | |
| 5,022,530 | A * | 6/1991 | Zieke | 383/204 |
| 5,158,499 | A * | 10/1992 | Guckenberger | 206/524.2 |
| 5,169,651 | A | 12/1992 | Heiber et al. | |
| 5,461,845 | A | 10/1995 | Yeager | |
| 5,558,438 | A | 9/1996 | Warr | |
| 5,664,303 | A | 9/1997 | Johnson | |

(Continued)

*Primary Examiner* — Sameh Tawfik
*Assistant Examiner* — Thomas M Wittenschlaeger
(74) *Attorney, Agent, or Firm* — Skaar Ulbrich Macari, P.A.

(57) ABSTRACT

The present invention addresses certain problems facing flexible packages and the packaging industry. Embodiments of the present invention are directed to a method of heat scoring the film or material of the package in various shapes and locations to facilitate the consumer opening the package. Embodiments are also directed to a heat scoring device for delivering the heat score to the package material during the manufacturing process. Other embodiments are directed to a package having one or more heat scores for permitting a user to easily access the contents of a package while maintaining the integrity of the package.

16 Claims, 7 Drawing Sheets

(56) References Cited

U.S. PATENT DOCUMENTS 5,672,009 A 9/1997 Malin
5,782,733 A 7/1998 Yeager
5,806,984 A 9/1998 Yeager
5,829,884 A 11/1998 Yeager
5,941,643 A * 8/1999 Linkiewicz ..... B65B 9/20 383/210
6,007,246 A 12/1999 Kinigakis et al.
6,053,635 A 4/2000 Anderson et al.
6,106,153 A 8/2000 Toshima
6,115,892 A 9/2000 Malin et al.
6,126,317 A 10/2000 Anderson et al.
6,224,262 B1 5/2001 Hogan et al.
6,290,390 B1 * 9/2001 Buchman ..... 383/5
6,345,911 B1 2/2002 Young et al.
6,347,885 B1 * 2/2002 Buchman ..... 383/5
6,350,057 B1 2/2002 Forman
6,516,850 B1 2/2003 Blohowiak et al.
6,517,242 B1 * 2/2003 Buchman ..... 383/5
6,533,711 B1 3/2003 Anderson et al.
6,616,333 B2 9/2003 Kinigakis et al.
6,659,643 B2 12/2003 Plourde et al.
6,820,391 B2 11/2004 Barmore et al.
6,910,995 B2 * 6/2005 Schneider ..... B65D 75/5805 493/213
7,175,581 B2 † 2/2007 Murray
7,207,717 B2 4/2007 Steele
7,261,468 B2 * 8/2007 Schneider et al. ..... 383/203
7,883,268 B2 2/2011 Steele
10,093,457 B2 10/2018 Steele
2002/0139704 A1 * 10/2002 Buchman ..... 206/459.1
2002/0152723 A1 * 10/2002 Ausnit ..... 53/412
2003/0044093 A1 * 3/2003 Schneider et al. ..... 383/5
2003/0124294 A1 * 7/2003 Hodson et al. ..... 428/43
2003/0210838 A1 11/2003 Steele
2003/0219173 A1 * 11/2003 Schneider ..... 383/9
2003/0219176 A1 * 11/2003 Kocher et al. ..... 383/64
2003/0231811 A1 * 12/2003 Hodson et al. ..... 383/208
2003/0235660 A1 * 12/2003 Blanchard ..... B26D 3/085 428/34.1
2004/0020166 A1 * 2/2004 Cortigiano, Sr. ... B29C 66/4322 53/412
2004/0031244 A1 2/2004 Steele
2004/0091648 A1 * 5/2004 Hartzell et al. ..... 428/34.3
2005/0025395 A1 * 2/2005 Howell et al. ..... 383/61.2
2005/0069227 A1 3/2005 Steele
2005/0199521 A1 9/2005 Givens, Jr.
2006/0113212 A1 6/2006 Steele
2006/0115187 A1 * 6/2006 Ausnit et al. ..... 383/63
2006/0127549 A1 † 6/2006 Murray
2006/0215942 A1 9/2006 Steele
2007/0062161 A1 * 3/2007 Dierl et al. ..... 53/412
2007/0189641 A1 8/2007 Steele
2007/0206888 A1 9/2007 Chang
2008/0002918 A1 1/2008 Steele
2008/0279485 A1 11/2008 Steele
2009/0180716 A1 7/2009 Steele
2009/0208147 A1 8/2009 Steele
2009/0238499 A1 9/2009 Steele
2009/0245699 A1 10/2009 Steele
2009/0266036 A1 * 10/2009 Zerfas et al. ..... 53/469
2009/0277916 A1 11/2009 Steele
2010/0012531 A1 1/2010 Steele
2010/0124385 A1 * 5/2010 Moulin ..... 383/5
2010/0226600 A1 9/2010 Steele
2011/0103714 A1 5/2011 Steele et al.
2011/0182531 A1 7/2011 Steele
2011/0253728 A1 10/2011 Steele
2012/0006702 A1 1/2012 Steele
2012/0074002 A1 3/2012 Steele et al.
2013/0266243 A1 * 10/2013 Kinigakis et al. ..... 383/9
2014/0315702 A1 * 10/2014 Wilson et al. ..... 493/213
2017/0066561 A1 3/2017 Steele

* cited by examiner
† cited by third party

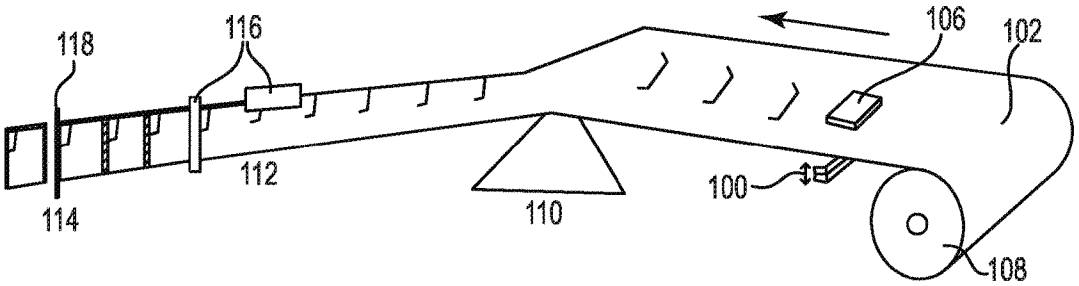
FIG. 4
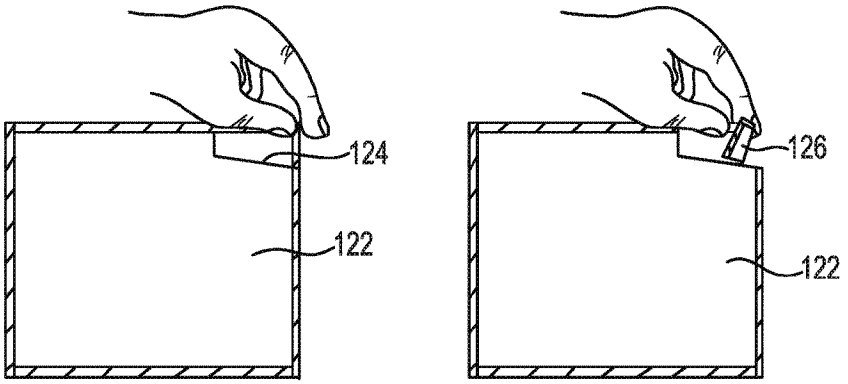
FIG. 5
FIG. 6
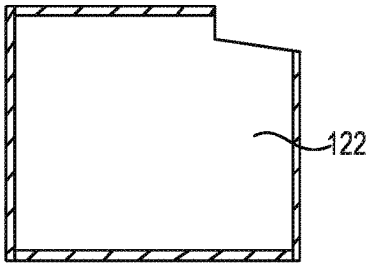
FIG. 7

PACKAGE WITH HEAT SCORE

PRIORITY

This Application claims priority to and the benefit of U.S. Provisional Application No. 61/428,658, filed Dec. 30, 2010 and U.S. Provisional Application No. 61/432,183, filed Jan. 12, 2011, both of which are hereby incorporated herein by reference in their entirety.

FIELD

The present invention relates generally to flexible packaging and, more particularly, to packages, and methods for forming and using packages, having a score line provided by a heat scoring method.

BACKGROUND

More and more flexible packages in the marketplace are using packaging materials and features that make it difficult for the users to open the package. It is undesirable for the consumer to require scissors or a knife to open these packages. Additionally, the normal process of tearing the package open by simply tearing the film at the location of a tear notch or tear slit, does not always result in a controlled tear of the package film. Some films tear across the body of the package and allow the product to fall out. Some films tear in unwanted locations that can negate the use of some of the desired features of the package, such as a reclose or handle feature.

There have been methods developed to address these issues, such as laser scoring the film or perforating the film in an area approximately where the consumer needs to remove or tear a part of the package to access the product. Laser scoring the film requires a precise means of burning through a portion of the outer layer of the film structure, typically a multi layer structure, in the area desired to tear later by the consumer. Although this process works in many applications, it is expensive and requires costly tooling to perform. The more difficult the desired tear shape and location, then the more difficult and costly the application. In some applications, laser scoring is not cost effective.

Another attempted solution is perforating the film for an easy, controlled, tear. However perforations are problematic because in certain applications, some films tear at the perforation at a time when not desired. Additionally, and more problematic, is that the barrier characteristics of the package are compromised by the perforations and the product freshness is negatively affected or some of the product may leak from the package.

Tear strips and tapes have also been tried, but are limited to where you can place them in the package and are typically limited to a straight line tear only. They will not allow for a contoured tear if required.

As a result, there is a need for a flexible package that substantially solves the above-referenced problems with conventional package designs, configurations, and manufacturing methods.

SUMMARY

The present invention addresses certain problems facing flexible packages and the packaging industry. Embodiments of the present invention are directed to a method of heat scoring the film or material of the package in various shapes and locations to facilitate the consumer opening the package. Embodiments are also directed to a heat scoring systems and devices for delivering the heat score to the package material during the manufacturing process. Other embodiments are directed to a package having one or more heat scores for permitting a user to easily access the contents of a package while maintaining the integrity of the package.

The detailed technology and preferred embodiments implemented for the subject invention are described in the following paragraphs accompanying the appended drawings for people skilled in this field to well appreciate the features of the claimed invention. It is understood that the features mentioned hereinbefore and those to be commented on hereinafter may be used not only in the specified combinations, but also in other combinations or in isolation, without departing from the scope of the present invention.

BRIEF DESCRIPTION OF THE DRAWINGS

FIG. 4 is a diagram of a heat scoring device and method in accordance with embodiments of the present invention.

FIGS. 5-7 are diagrams showing the opening of a package having a heat score in accordance with embodiments of the present invention.

DETAILED DESCRIPTION

Figure 1:
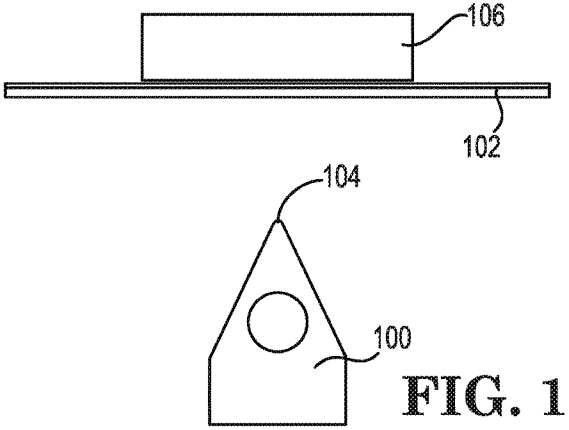
FIGS. 1-3 are diagrams of a heat scoring device and method in accordance with embodiments of the present invention.

In the following descriptions, the invention will be explained with reference to various example embodiments; nevertheless, these embodiments are not intended to limit the present invention to any specific example, environment, embodiment, applications, or particular implementations described herein. Therefore, descriptions of these example embodiments are only provided for purpose of illustration but not to limit the present invention. It should be appreciated that elements unrelated directly to the present invention are omitted from the embodiments and the attached drawings. References to "top," "bottom," "front," "back," "side" and the like are for illustrative purposes only and are not meant to limit the scope of the disclosed invention.

A package according to certain embodiments of the invention comprises two-layer laminated film, the first film layer being a polyethylene sealant and the second being a polyester barrier film. Although, virtually any variety and or combination of films can be used within the scope of the invention, including co-extrusions, adhesive laminates, extrusion laminates, mono layers and blends. For example, the film material may comprise polyethylene, polyester, metal foil, polypropylene, or polyethylenes or polypropylenes laminated with other materials such as nylon, polyester, and like films. To provide for higher barriers, embodiments can use combination layers of said materials and material of the like. In addition, various panel portions can be constructed of, or incorporated with, materials that provide preferred sealing characteristics. One skilled in the art will understand that a myriad of materials and material laminates are available and can be used without departing from the scope of the invention.

Referring to FIGS. 1-4, a heated scoring tool 100 is made in the shape conforming to the shape of the desired tear in the film. The tool 100 is applied to the sealant (polyethylene) side of the laminated web 102 while the web is in a flat state. The tool 100 is typically made of steel and is Teflon coated. However, other materials and coatings (or no coating) may be used without departing from the scope of the invention. The heat can be produced from a heated element connected to or disposed inside the scoring tool 100, from an ultrasonic device, or any other device that can move or remove material or otherwise score the film as described herein.

The scoring edge 104 of the tool 100 that makes contact with the film is very narrow, however not sharp to the point that it would cut the film 102. The edge 104 can also be flat or another appropriate contour. The width and contour of the tool edge 104 is selected based upon the type and thickness of the film being scored and the desired results when the film is torn open. In one example range, the edge thickness is between 1/64" and 1/4" wide. However other thicknesses are within the scope of the invention. On the opposite side of the film to be heat scored 102 is a backer plate or anvil 106. Plate 106 provides a support surface so that the film 102 does not stretch or displace during the scoring process. Thus a consistent score can be delivered by the tool 100.

Figure 2:
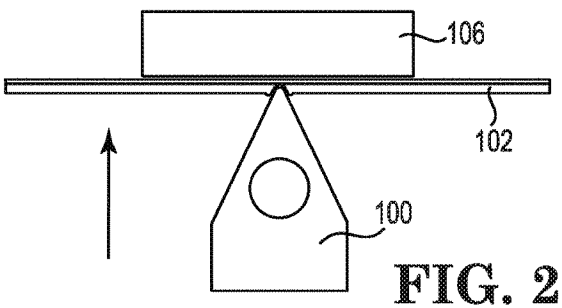
Figure 3:
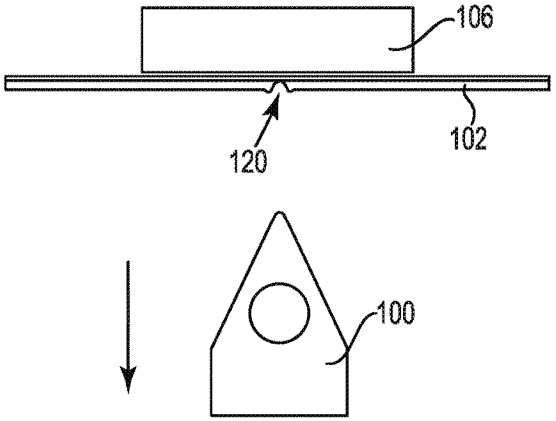

As the film 102 is unwound from a roll 108 (shown in FIG. 4), and passed through a dancer section to make the film 102 run in an intermittent motion, the heated scoring tool 100 can cycle up and down (indicated in FIGS. 2 and 3 respectively) to make contact with the material in the desired location of where it is desired for the film to tear for the consumer, later, when they access the package. Thus, as shown in FIGS. 2-3, the heated scoring tool 100 cycles up to make contact with the sealant side of the film 102. The backer plate 106, located opposite the heated scoring tool 100, keeps the film 102 from deflecting away from the tool 100. The backer plate 106 also insures the heated scoring tool 100 makes parallel contact with the film 102, so no one area has greater pressure applied than the other areas.

The tool 100, when making contact with the film, both displaces the polyethylene sealant film away from where the heat and pressure are being applied, and may crystallize the film where it makes contact. A cooling anvil may also be provided to contact the film immediately after this step to promote setting or crystallizing, of the film structure.

The polyethylene film is not completely displaced, there is normally a thin layer still remaining where the tool 100 made contact. The shape of the tool edge 104 defines the shape of the score line, so any desired 2-dimensional heat score shape may be applied to the package film. In addition, the pressure and/or distance between the tool 100 and the backer plate 106 can be adjusted for the desired material displacement to ensure the proper tear of the film, later, when the consumer opens the package.

Once this process is completed, the film 102 can further be processed into a package, either as a pre-made pouch, or on any form, fill and seal packaging line. In FIG. 4, material folding 110, sealing 112 and cutting 114 stations are illustrated. Sealing station 112 includes one or more sealing bars 116. Cutting station includes one or more cutting blades 118. However, the manufacturing process according to the invention can also include additional steps or fewer steps than recited herein.

The heat score area 120 will not always be able to be seen from the outside of the package, since it is typically done on the web surface that is disposed to the inside of the package, so graphic illustrations and or instructions can be provided on the outside of the package to show the consumer where to tear the package open. Because the film is not perforated, and the barrier structure (the polyester in this example description) has not been compromised, the sealing integrity and barrier characteristics of the package are maintained until the user desires to open the package.

In an alternative forming operation, a linear heat scoring line or lines can be formed with a stationary heated device that makes contact with the side of the film requiring scoring as the film passes over the device. This device can be designed to back away from the material when the machine is stopped, so as not to burn through the film, and go back into position when the film is running in continuous motion again. In a further alternative, a rotating scoring element comprising one or more edges can rotate respective to the passing of the web, making controlled periodic score marks on the web.

Referring to FIGS. 5-7, a package 122 having a heat score line 124 is shown. The heat score line 124 is shown on the outside of the package 122 for illustration purposes. Typically the heat score line is not visible from the outside of the package. As shown in FIG. 6, the consumer grabs the packaging material where instructed and begins to pull the scored portion 126 of the package 122 back against itself. In doing this, the film tears along the pathway of the heat score 124 and the desired controlled tearing open of a portion 126 of the film is easily accomplished. The severable portion 126 of the package is shown removed in FIG. 7.

Figure 9:
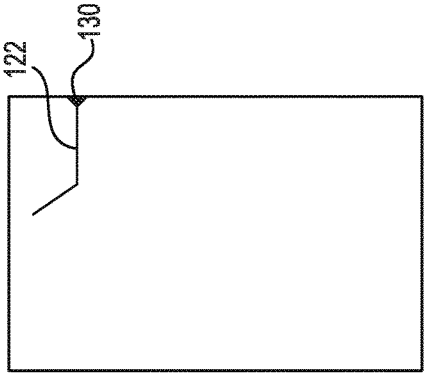
FIGS. 8-9 are diagrams showing the folding of a heat-scored film into a package in accordance with embodiments of the present invention.
Figure 8:
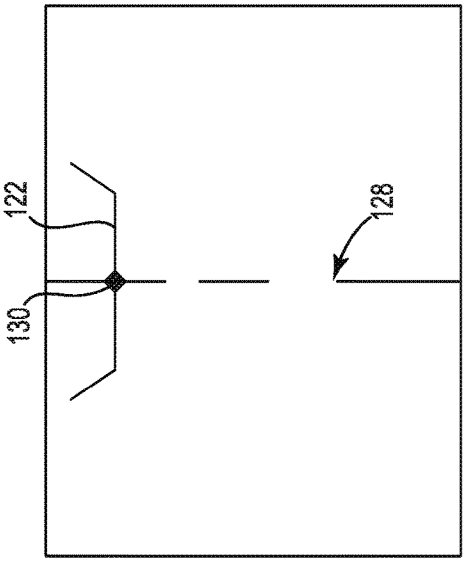

FIGS. 8-9 illustrate the folding of a film, having a heat score as discussed herein, into a package. A fold line 140 in FIG. 8 indicates where the film is folded and sealed along its edges to form the sealed package of FIG. 9. The heat score line 124 can be seen in both figures. A tear spot 130 can be provided as part of the score line so that it exists at least one of a start and end of the score line. Although, preferable a tear spot 130 exists at an edge of the package where the tear is intended to start. The tear spot 130 can be formed as part of the score line forming process by a respective shape of the tool having the desired shape and placement of the tear spot 130.

Figure 11:
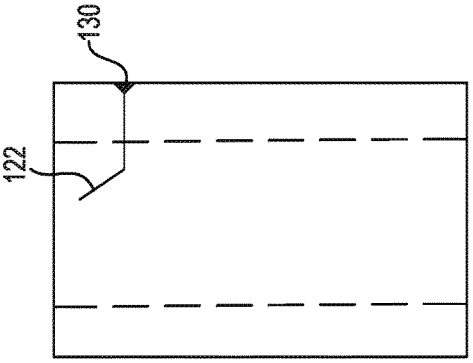
FIGS. 10-11 are diagrams showing the folding of a heat-scored film into a package having gussets in accordance with embodiments of the present invention.
Figure 10:
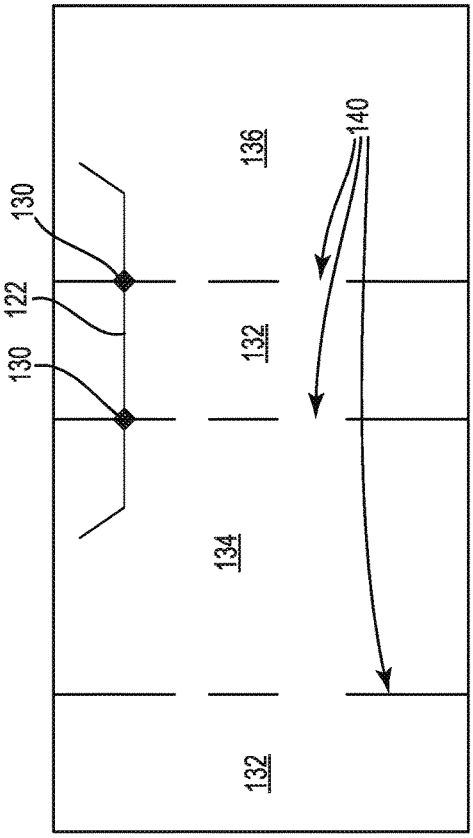
Figure 13:
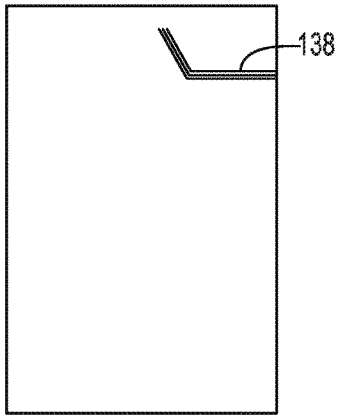
FIGS. 12-15 are diagrams showing the folding of a multi-heat-scored film into a package having gussets in accordance with embodiments of the present invention.

FIGS. 10-11 illustrate the folding of a film, having a heat score as discussed herein, into a package that is gusseted. The film as shown in FIG. 10 includes a gusset 132 disposed between the front panel 134 and back panel 136 portions. An additional gusset 132 can be provided adjacent one of the front 134 or back panels 136. Fold lines 140 are indicated at the boundary of the respective adjacent portions. The score line 124 is again provided and here traverses a portion of the front 134, back 136 and intervening gusset 132 portions of the web. Tear spots are provided along the score line now at two points where the edges of the front/gusset panels and back/gusset panels will come together in the completed package. The completed package is shown in FIG. 11.

Figure 12:
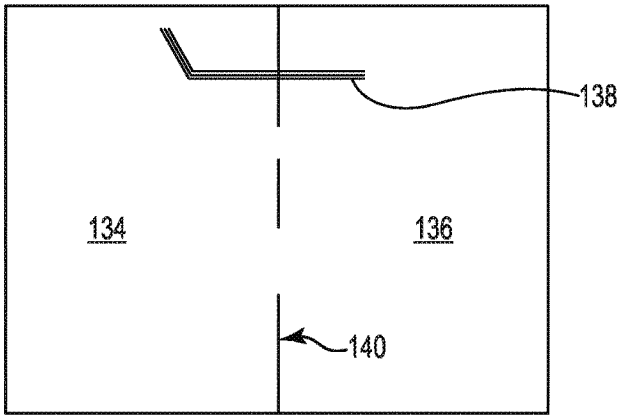
Figure 14:
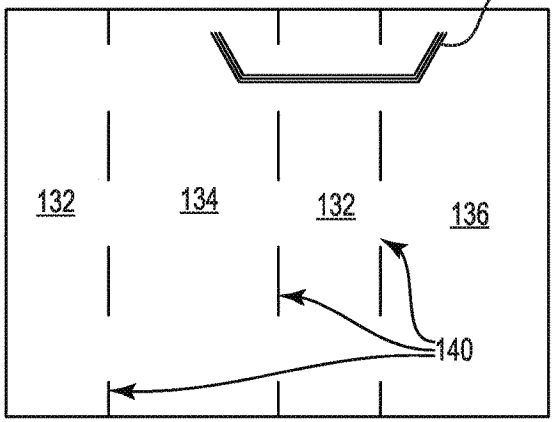
Figure 15:
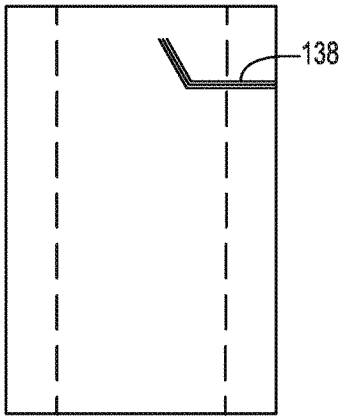
Figure 17:
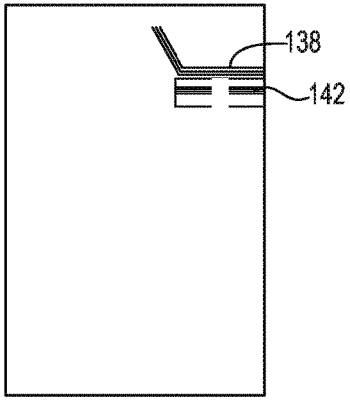
FIGS. 16-19 are diagrams showing the folding of a heat-scored film into a package having gussets and a reclosure device in accordance with embodiments of the present invention.
Figure 19:
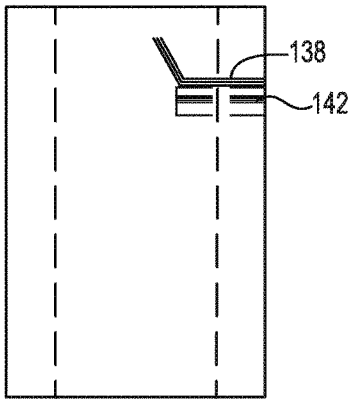

FIGS. 12-15 illustrate the folding of a film, having multiple heat score lines as discussed herein, into a package that is non-gusseted (FIGS. 12-13) or gusseted (FIGS. 14-15). A package with multiple heat score lines 138 provides for a larger target area for the consumer/tear slit or notch to line up with for opening. Also, the multiple score lines allow for a greater opportunity for a tear to follow one of the other score tracks if the tear should jump out of a given score line being followed. Referring to FIG. 12, a fold line 140 is indicated to show where a front 134 and back 136 panel portions are folded together and have their edges sealed to form the package shown in FIG. 13. Referring to FIG. 14, gusset portions 132 are defined with respect to front 134 and back 136 panel portions by multiple fold lines 140 as discussed regarding FIG. 10. The resulting finished package is shown in FIG. 15. Tear spots are not shown in these figures, but can be optionally included.

Figure 16:
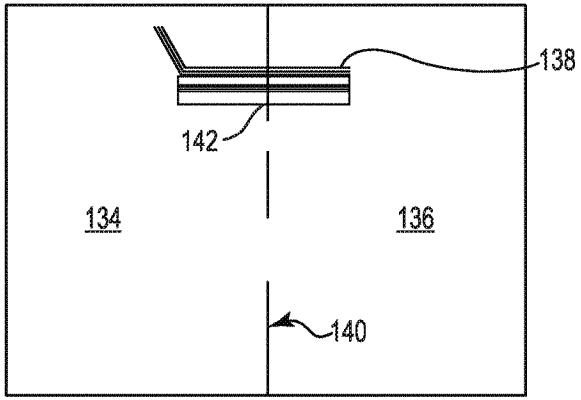
Figure 18:
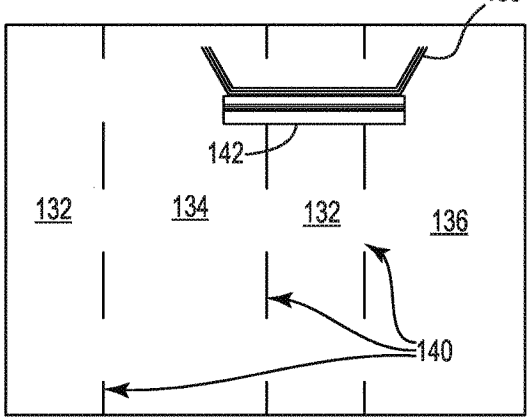
Figure 20:
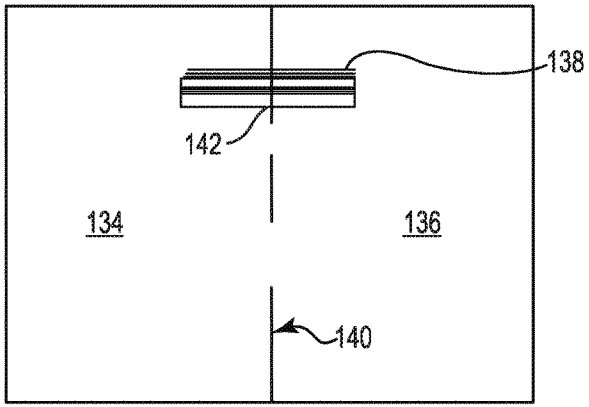
FIGS. 20-23 are diagrams showing the folding of a heat-scored film into a pillow-pack package in accordance with embodiments of the present invention.

FIGS. 16-17 and 18-19 illustrate the folding of a film as discussed with regard to FIGS. 12-13 and 14-15, respectively, but now a reclosure device 142 is provided to the package. The reclosure device 142 can be a zipper or other reclosable device. Single or multiple heat score lines 138 along the top of a reclose device 142 in conjunction with a tear slit or tear notch can be provided to the film as indicated in FIGS. 16 and 18. The package is then folded and formed as discussed previously. In use, the consumer can tear the package starting at the slit/notch/tear spot and the film will tear toward the reclosure device, and once contact is made, will follow the heat score positioned on an edge of the reclosure device to further guide the tear along the edge (the top edge as shown here) of the reclose device 142. The reclose device 142 further helps keep the film tear in the heat score line by providing a heavier structure to stop the tear started at the top of the pouch and redirect it to the side of the pouch along the desired tear path.

Figure 21:
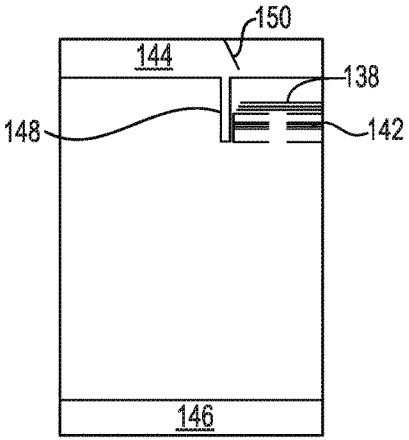
Figure 22:
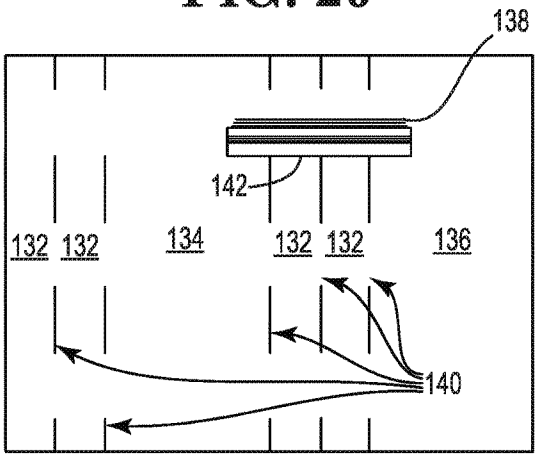
Figure 23:
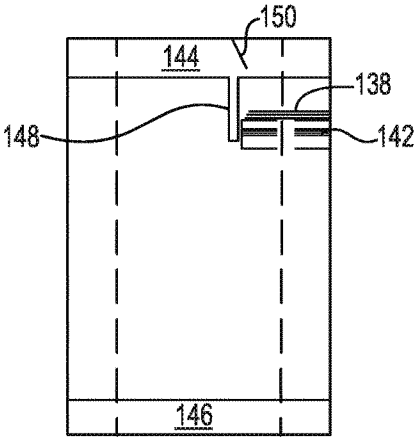

FIGS. 20-21 and 22-23 illustrate an alternative embodiment similar to that shown in respective FIGS. 16-17 and 18-19, but the score line(s) are now linear and a top 144 and bottom 146 sealed portion is provided to the package. Also, when the panel portions are folded together as shown in FIGS. 21 and 23, a small vertical seal 148 is formed adjacent to the score lines opposite the edge of the package. The vertical seal 148 is oriented generally normal to the top seal portion of the package. Vertical seal 148 functions to keep package contents from becoming located between the top seal portion 144 and the top of the reclosure device 142. Thus, contents does not spill when the package is torn open. A slit or tear notch 150 in the film is provided to the top seal portion. The slit or notch can be configured to direct the tear in a desired direction, for example at an acute angle with respect to the top edge of the package. FIG. 22 also illustrates that multiple gusset portions 132 can be provided to the package, with a respective fold line disposed at the respective boundaries.

Figure 24:
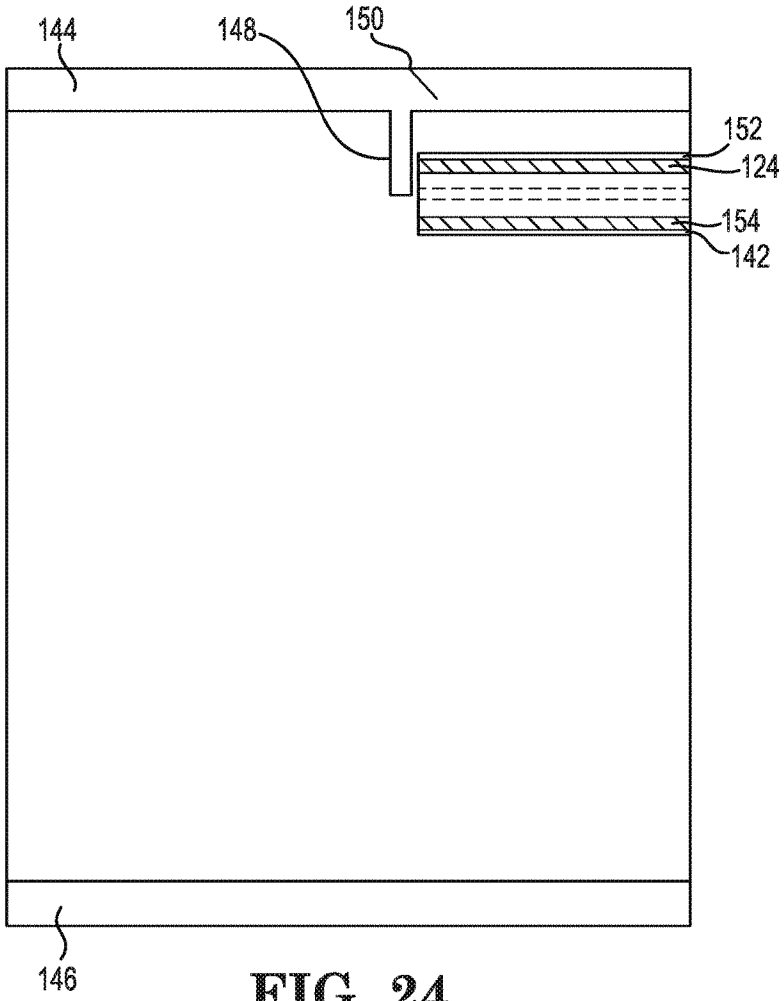
FIG. 24 is a diagram showing a further embodiment in accordance with the present invention.

In a further embodiment, the score line 124 can be formed by a seal bar instead of a separate scoring tool. For example, as a seal bar seals a portion of a package, it can also impart a score line 124 or lines into the package using heat and pressure. This can be well understood in reference to FIG. 24. In this example embodiment, a reclosure device 142 is provided to the film during the manufacturing process. The reclosure device is provided by pressing a seal bar down on the top and bottom edges of the reclosure device using heat and pressure. The pressure and heat applied by the seal bar displace material from a portion of the top edge 152 of the reclosure member 142 and the adjacent film layer of the web. Thus, the seal bar imparts a score line 124 formed along or adjacent to the top edge 152 of the reclosure device 142 as shown in the figure. Note that the bottom seal portion 154 of the reclosure device 142 (here a zipper) is shown for context. This embodiment eliminates the separate scoring tool described previously and its associated step in the manufacturing process.

In use with this embodiment, the user begins a tear with the directional slit 150 provided in the top seal portion 144 of the package. Continued tearing action causes the tear to be extend generally in the direction of the directional slit until the tear encounters the score line along the top edge 152 of the reclosure device 142. Then the tear will follow this score line until the tear completes the opening of the package. The reclosure device 142 can be used to re-close or re-seal the package as desired.

A variety of shapes and sizes of openings can be accomplished by employing certain embodiments of the method, apparatus and system disclosed herein. The method, system and apparatus can be applied to a wide variety of packages and materials for packages. In addition, the aspect of applying the heat score while the film is in a flat state facilitates placement of the scope line virtually anywhere on the package as may be desired, without being limited by the shape of the finished package or the features on the finished package.

Heat scoring methods and packages typically are arranged to that the inside sealant material is scored, but alternatively, scoring can be performed on the outside film as well (or in the alternative to the inside), be it a barrier film like a nylon or polyester, a co-extrusion, a lamination, mono layer polyethylenes or polypropylenes, or any other single or combination film type or lamination.

The present invention may be embodied in other specific forms without departing from the spirit or essential attributes thereof, and it is, therefore, desired that the present embodiment be considered in all respects as illustrative and not restrictive. Similarly, the above-described methods and techniques for forming the present invention are illustrative processes and are not intended to limit the methods of manufacturing/forming the present invention to those specifically defined herein. A myriad of various unspecified steps and procedures can be performed before, between or after any of the various steps of the method. In addition the steps of the method can be performed in any order without departing from the scope of the invention. Moreover, features or aspects of various example embodiments may be mixed and matched (even if such combination is not explicitly described herein) without departing from the scope of the invention.

What is claimed is:

1. A method of scoring a flexible package, comprising:

providing a generally flat film material comprising a first inner layer and a second outer layer, the generally flat film material having opposing longitudinal edges;

providing a heat scoring device having a scoring edge;

providing a reclosure zipper device having first and second zipper longitudinal flange edges provided generally transverse to the opposing longitudinal edges of the film, and first and second zipper end portions extending between and generally transverse to the first and second zipper flange longitudinal edges to define a zipper side perimeter boundary;

forming a top seal transverse to the opposing longitudinal edges of the film;

forming a score line in the first inner layer of the film, and not in the second outer layer, wherein a portion of the first inner layer of film along the score line is crystallized with the application of heat and pressure from the scoring edge of the scoring device to form a crystallized weakened pathway generally parallel with and at least partially intermediate the first and second zipper longitudinal edges, thereby bonding the first inner layer to and along one of the first and second zipper flange longitudinal edges from one of the opposing longitudinal edges of the film to the first zipper end portion of the reclosure zipper, without extending beyond the zipper side perimeter boundary; and placing a directional tear slit defined in the top seal.

2. The method of claim 1, wherein the directional tear slit is generally linear.

3. The method of claim 1, wherein the first inner layer comprises polyethylene and the second outer layer comprises polyester.

4. The method of claim 1, further comprising forming multiple score lines in the first inner layer.

5. The method of claim 1, wherein the directional tear slit is angled relative to the top seal.

6. The method of claim 1, further including a tear spot at an edge of the package.

7. The method of claim 6, wherein the tear spot is included with the directional tear slit.

8. The method of claim 1, further providing a gusseted panel portion.

9. A method of scoring a package, comprising:

providing a generally planar film material comprising at least two layers and having first and second longitudinal edge portions and a top edge portion generally transverse to and extending between the first and second longitudinal edge portions;

providing a heat seal device having a scoring section;

providing a reclosure zipper device to the film generally transverse to at least the first longitudinal edge portion of the film, the reclosure zipper device having a longitudinal attachment flange, the longitudinal attachment flange having an end portion extending generally transverse therefrom to define a zipper side boundary;

forming a top seal along the top edge portion;

forming, with the scoring section of the heat seal device, a score line in an interior layer of the at least two layers of the film, not generally visible from an outside of the package and not defined in an outer layer of the at least two layers, wherein the heat seal device displaces and crystallizes with heat and pressure the interior layer along the score line to provide a crystallized path of weakness and seals the interior layer and the longitudinal attachment flange together at least partially intermediate the first and second zipper longitudinal edges, without extending beyond the zipper side perimeter; and placing a directional tear slit in the top seal of the package, directed towards the score line.

10. The method of claim 9, wherein the directional tear slit is generally linear.

11. The method of claim 9, wherein the interior layer comprises polyethylene.

12. The method of claim 9, further comprising forming multiple score lines in the interior layer.

13. The method of claim 9, wherein the directional tear slit is angled relative to the top seal.

14. The method of claim 9, further including a tear spot at an edge of the package.

15. The method of claim 14, wherein the tear spot is included with the directional tear slit.

16. The method of claim 9, further providing a gusseted panel portion.

* * * * *